US011542565B2

(12) United States Patent
Hutmacher et al.

(10) Patent No.: US 11,542,565 B2
(45) Date of Patent: Jan. 3, 2023

(54) CHARGING SYSTEM, IN PARTICULAR FOR A SHAFT SMELT REDUCTION FURNACE

(71) Applicant: PAUL WURTH S.A., Luxembourg (LU)

(72) Inventors: Patrick Hutmacher, Bettembourg (LU); Stefan Schons, Tawern (DE); Charles Steichen, Schlindermanderscheid (LU); Michel Houbart, Amay (BE)

(73) Assignee: PAUL WURTH S.A., Luxembourg (LU)

( * ) Notice: Subject to any disclaimer, the term of this patent is extended or adjusted under 35 U.S.C. 154(b) by 298 days.

(21) Appl. No.: 16/767,014

(22) PCT Filed: Dec. 6, 2018

(86) PCT No.: PCT/EP2018/083843
§ 371 (c)(1),
(2) Date: May 26, 2020

(87) PCT Pub. No.: WO2019/110748
PCT Pub. Date: Jun. 13, 2019

(65) Prior Publication Data

US 2020/0318207 A1 Oct. 8, 2020

(30) Foreign Application Priority Data

Dec. 7, 2017 (LU) ..... LU100535

(51) Int. Cl.
*C21B 13/02* (2006.01)
*C21B 7/00* (2006.01)
(Continued)

(52) U.S. Cl.
CPC ..... *C21B 13/02* (2013.01); *C21B 7/002* (2013.01); *C21B 7/02* (2013.01); *F27B 1/20* (2013.01); *F27D 3/0033* (2013.01)

(58) Field of Classification Search
None
See application file for complete search history.

(56) References Cited

U.S. PATENT DOCUMENTS 1,945,341 A 1/1934 Brassert
3,594,154 A 7/1971 Kanokogi
(Continued)

FOREIGN PATENT DOCUMENTS

CN 1135773 A 11/1996
CN 1238389 A 12/1999
(Continued)

OTHER PUBLICATIONS

CN Office Action dated Oct. 9, 2021 re: Application No. 201880078795.4, pp. 1-11, citing: CN107208167A, GB1176740A, DE194613C, CN102725426A, CN1135773A, CN1238389A, CN1545562A, US20030000343A1, JP2010116587A and CN1498278A.
(Continued)

*Primary Examiner* — Scott R Kastler
(74) *Attorney, Agent, or Firm* — Cantor Colburn LLP

(57) ABSTRACT

A charging system for a shaft smelt reduction furnace includes a frame structure for mounting on a top charge opening of a shaft smelt reduction vessel; a center shaft arrangement supported by the frame structure and for removing off-gas gases from the furnace and to introduce granular charge materials to form a stack of materials in the furnace. The center shaft arrangement includes a center hood for off-gas extraction; a pair of first and second feed channels for first and second materials.

The center hood includes a pair of facing off-gas panels defining an off-gas channel.
(Continued)

The partition walls include lower portions that extend towards each other below the center hood to define a center feed passage, whereby material descending through the first feed channels may accumulate on lower portions according to the angle of repose of the material, permitting self-adjustment of the first material stock-line in the shaft arrangement.

10 Claims, 2 Drawing Sheets

(51) Int. Cl.

| | |
|---|---|
| ***C21B 7/02*** | (2006.01) |
| ***F27B 1/20*** | (2006.01) |
| ***F27D 3/00*** | (2006.01) |

(56) References Cited

U.S. PATENT DOCUMENTS

| | | | | |
|---|---|---|---|---|
| 5,829,968 | A | 11/1998 | Lonardi et al. | |
| 5,965,085 | A | 10/1999 | Abramin et al. | |
| 6,517,603 | B2 | 2/2003 | Contrucci et al. | |
| 6,692,688 | B2 | 2/2004 | Contrucci et al. | |
| 2003/0000343 | A1 | 1/2003 | Contrucci et al. | |
| 2020/0318207 | A1* | 10/2020 | Hutmacher | C21B 7/002 |

FOREIGN PATENT DOCUMENTS

| | | | |
|---|---|---|---|
| CN | 1498278 | A | 5/2004 |
| CN | 1545562 | A | 11/2004 |
| CN | 102725426 | A | 10/2012 |
| CN | 107208167 | A | 9/2017 |
| DE | 194613 | C | 6/1906 |
| DE | 1758372 | A1 | 2/1972 |
| GB | 1176740 | A | 1/1970 |
| JP | 2010116587 | A | 5/2010 |
| WO | 2009082125 | A2 | 7/2009 |
| WO | 2013010725 | A1 | 1/2013 |

OTHER PUBLICATIONS

International Search Report dated Feb. 1, 2019 re: Application No. PCT/EP2018/083843, pp. 1-3, citing: DE 194 613 C and DE 17 58 372 A1.

Written Opinion dated Feb. 1, 2019 re: Application No. PCT/EP2018/083843, pp. 1-6, citing: DE 194 613 C and DE 17 58 372 A1.

IN Office Action dated Apr. 20, 2022 re: Application No. 202017023230, pp. 1-6, citing: US3594154A, WO2009082125A2 and WO2013010725A1.

* cited by examiner

CHARGING SYSTEM, IN PARTICULAR FOR A SHAFT SMELT REDUCTION FURNACE

TECHNICAL FIELD

The present disclosure generally relates to the field of metallurgical furnaces intended for the production of pig iron, cast iron, or any other alloyed cast metal, from a solid charge. More specifically it relates to a charging system that is particularly designed for shaft smelt reduction furnaces.

BACKGROUND

Smelting reduction technology is an alternative technology to the conventional blast furnace. The blast furnace has been the dominant technology for iron production for centuries. Its operation has been improved and optimized continually; this has resulted in very efficient large-scale operating facilities.

Smelting reduction technology is a typically coal-based ironmaking process, which, as the name clearly suggests, involves both solid-state reduction and smelting.

In shaft furnaces, the gasses formed by the combustion ascend through the furnace in counter-current flow to the charge. The contact between these gasses and the charge will influence the efficiency of the furnace significantly. A constant and homogeneous charging level is therefore desirable to achieve good permeability and distribution of the gasses.

In this context, the conventional equipment and methods used for feeding and distribution of charges in circular cross section shaft furnaces are already known, such as for example those used with blast furnaces, electric reduction furnaces, cupola furnaces, and the like.

Specifically, in blast furnaces the charge formed of classified ore, pellets, sintered or other conventional agglomerates, coke and limestone is charged sequentially through the upper part of the furnace to form a vertically continuous multi-layer charge. The charge is distributed uniformly along the furnace cross section depending on the granular size of its constituents to ensure good permeability and distribution of the ascending gasses in counter current flow to the charge. This is achieved by the use of rotating distributors and/or deflectors that are fed with charge material from a single location.

In furnaces having rectangular cross sections, such as for example in shaft smelt reduction furnaces, the charge comprising iron ore is charged through a central upper shaft while the fuel is charged laterally.

In order to improve the efficiency of the thermal exchange between the ascending gasses and the charge by minimizing the wall effect and to optimize the uniformity of the permeability, columns of different materials are conventionally formed. Since the length of these furnaces is quite longer than the width thereof, the use of the distributors employed in circular cross section furnaces may not be adequate for these furnaces.

An example of smelting reduction furnace is for example disclosed in U.S. Pat. No. 1,945,341. The charging of the furnace is carried out to form a center column of coarse ore, whereas a mixture of small coal and fine is charged adjacent the walls. The main embodiment described therein concerns a furnace of circular cross-section equipped with a charging installation comprising a bell and hopper. Although also evoking the possible use of a furnace of rectangular cross-section, no other charging installation is described. It is however clear that the conventional blast furnace equipment is not appropriate for rectangular furnaces.

DE 194 613 discloses a blast furnace arrangement having a central gas offtake pipe, wherein feed openings are arranged circularly around the blast furnace.

DE 1758372 discloses a charging system for a blast furnace arranged over a cylindrical furnace shaft. It comprises a large ball valve in a lower hopper, lateral hoppers feeding a shoot and the lower hopper, as well as central hopper with shoot and ball valve. The valve and hoppers are arranged to cooperate with inner and outer circular partition walls extending downwardly into the furnace shaft and that allow forming a central and two annular material stacks.

SUMMARY

The present disclosure provides an improved charging system, which enables a constant and homogeneous charging/stockline level of material independent of the length and width (or diameter) of the furnace.

This is achieved by providing a charging system as claimed in claim 1.

According to the present disclosure, a charging system for a shaft smelt reduction furnace comprises:

a frame structure for mounting on a top charge opening of a smelt reduction vessel;

a center shaft arrangement supported by the frame structure and configured to remove off-gas gases from the furnace and to introduce granular charge materials in order to form a stack of materials in the furnace, said center shaft arrangement comprising:

- a center hood for off-gas extraction;
- a pair of first feed channels for a first material, one on each side of said center hood; and
- a pair of second feed channels for a second material arranged on respective sides of said first feed channels;

The center hood comprises a pair of facing off-gas panels defining the off-gas channel, each off-gas panel cooperating with a respective partition wall to define a respective first feed channel. Each partition wall cooperates with a respective outer wall to define a respective second feed channel.

The partition walls comprise lower portions that extend towards each other below the center hood to define a center feed passage, whereby material descending through the first feed channels may, before flowing through the center feed passage, accumulate on the lower portions according to the angle of repose of said material.

By way of this inventive design, the lower portions of the partition walls provide accumulation surfaces on which the first material may accumulate freely and thus according to the angle of repose of the material. This permits self-adjustment of the first material stock-line in the shaft arrangement, and this over the whole length of the center feed passage.

A main benefit of the disclosure is thus to provide a charging system ensuring a constant and uniform stock-line level of the central material stack, thereby enabling good and constant permeability and distribution of the gasses rising in the furnace. The charging system comprises lesser parts than in conventional designs using moving chutes; it is thus less exposed to wear. The stock-line level is self-adjusting; and there are no boundary conditions or limitations with respect to the length or width of the furnace.

The present charging system has been particularly designed for shaft smelt reduction vessels of rectangular (horizontal) cross-section. However it can also be implemented for circular vessels.

Advantageously, the charging system further comprises two lateral feeders, each mounted to the frame structure and opening into the furnace downstream of the center shaft arrangement. As it will be understood, this allows forming 5 different vertical columns of material in the furnace:

a central material column formed by the material flowing through the center feed passage;

two columns of material formed by the pair of second feed channels, one on each side of the central column; and two outer columns of material (along the longitudinal furnace walls) formed by the lateral feeders.

The content of each column of material may be selected depending on the desired mode of operation of the furnace. Generally, a column may be composed as a fuel column or as a metal column.

In general, a fuel column may comprise one or more of coal, coke, carbonaceous material, wood, charcoal, and may possible include waste material such as reducing waste or some amounts of metal bearing materials.

In general, a metal column will comprise material to be reduced, in particular one or more of ore, waste, iron ore, dust.

These materials have different granulometries, ranging from fine to coarse, which may vary from one column to another. Also, the materials may have been agglomerated by any appropriate process.

In an embodiment, each partition wall comprises a straight upper portion, preferably vertical, which is connected to the lower portions. The lower portions extend lower than the off-gas panels and under the off-gas channel, said center feed passage having a narrower flow cross-section than said off-gas channel.

Preferably, the outer walls comprise each a lower portion connecting with said frame to define a charge passage, downstream of the center feed passage, that is vertically aligned with the vessel top charge opening. In particular, the lower portion of each outer wall may comprise an inwardly tapering section and a vertical section that is positioned in vertical alignment with the respective off-gas panel or further inward. This charge passage defines the (transversal) width of the material stack formed by the center shaft arrangement.

In embodiments, the off-gas panels are designed to be of adaptable (vertical) length. In practice, the off-gas panels may be removably mounted in the center hood, to allow their exchange with off-gas panels of different lengths. Modifying the length of the off-gas panels will modify the distance separating the lower edges of the off-gas panels from the corresponding lower portions of the partition walls, to play on the stock-line level of the first material. For example, increasing this distance will raise the stock-line level of the first material.

According to another aspect, the present disclosure also concerns a smelt reduction furnace comprising smelt reduction vessel and the present charging system mounted on a top charge opening of the smelt reduction vessel. In embodiments, the smelt reduction vessel is of generally rectangular cross-section.

BRIEF DESCRIPTION OF THE DRAWINGS

The present disclosure will now be described, by way of example, with reference to the accompanying drawings, in which.

DETAILED DESCRIPTION OF THE DRAWINGS

Figure 1:
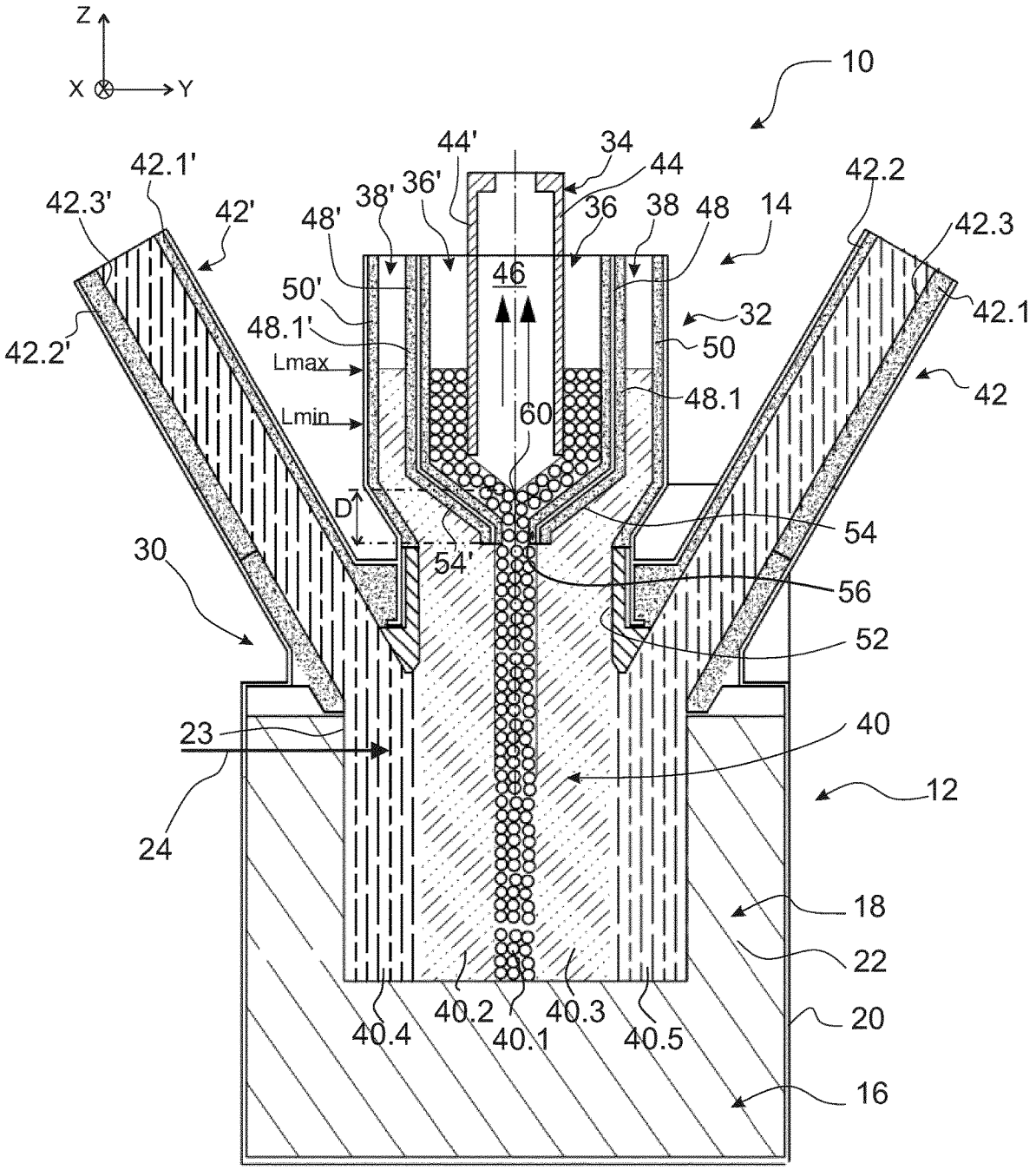
FIG. 1: is a cross-sectional view through a shaft smelt reduction furnace comprising the present charging system.

FIG. 1 shows, in a transversal cross-section, a shaft smelt reduction furnace 10 equipped with an embodiment of the present charging system. The longitudinal, transversal and vertical axes (X, Y, Z) are presented in the figures mainly for ease of explanation.

Such furnace 10 is a type of shaft furnace, where it is conventionally distinguished between the lower shaft region formed by a smelt reduction vessel 12 and the upper shaft region formed by a charging system, generally indicated at 14, arranged on the vessel 12.

The smelt reduction vessel 12 conventionally includes a bottom wall 16, forming the furnace hearth, and lateral walls 18. In practice, these walls comprise an outer metallic envelope 20 internally covered by a ceramic wear lining 22. Vessel 12 is typically of rectangular cross section as seen in a horizontal plane, i.e. in plane (X, Y). It may be noted that the cross-section view of FIG. 1 is a vertical cross section view along the width of the furnace, meaning that the length axis of the furnace (length axis of the vessel) is parallel to axis X in the drawing.

The vessel 12 thus comprises two longitudinal walls 18 extending along the furnace length axis and two end walls 18' (in FIG. 2), perpendicular to the length axis. These walls define an interior volume of generally rectangular parallelpipedic shape, the interior top edges of these walls defining the rectangular charge opening 23 at the top of vessel 12.

Conventionally, vessel 12 further includes a number of tuyeres, materialized by arrows 24, for injecting hot air blasts in the lower shaft region; as well as one or more tap holes (not shown) for extracting the hot metal.

The shaft smelt reduction vessel 12 is only briefly described herein since it is not the focus of the disclosure and can be of conventional and/or of any appropriate design.

Referring now more particularly to the charging system 14, it comprises a frame structure 30 that is mounted on the vessel opening 23 defined by the top edges of the furnace walls 18, 18'.

The frame structure 30 supports a center shaft arrangement 32 configured to extract gases from the vessel interior and for introducing material, namely meltdown material, into the furnace. The center shaft arrangement 32 extends along the furnace length axis X and comprises:

- a center hood 34 for off-gas extraction;
- a pair of first feed channels 36, 36' for a first material, one on each side of the center hood 34;
- a pair of second feed channels 38, 38' for a second material, again laterally arranged with respect to each first feed channels 36, 36'.

As can be seen in FIG. 1, the center shaft arrangement 32 is designed to form a vertical stack 40 of materials in the shaft furnace 10, comprising several columns of material.

In the present design, a pair of lateral feeders 42, 42', one on each side of the center shaft arrangement 14, is advantageously provided to introduce a third material into the furnace.

For the production of pig iron in the furnace, iron bearing material is typically fed into the second feed channels 38, 38'. Reducing material, mainly carbonaceous material, is introduced via the first feed channels 36, 36' and the lateral feeders 42, 42'.

In FIG. 1, the stack 40 is shown schematically as extending vertically over the whole furnace height. However, in use, it is clear that the lower shaft region contains molten metal. From the process perspective, the fuel (reducing/carbonaceous material) and iron bearing material are preheated and partially reduced in the upper shaft region. The charge is then melted under a reducing atmosphere in the central melting zone. Final reduction of residual iron oxides occurs as well slagging of gangue and ashes proceeds in the lower shaft region. Metal and slag droplets super heat and accumulate in the hearth.

The configuration of the center shaft arrangement 14 and lateral feeders 42, 42' allows forming into the furnace a stack 40 of material comprising a central column 40.1 that results from the material flowing through the first feed channels 36, 36' and further through central feed opening 56. Central material column 40.1 is in-between two columns 40.2 and 40.3, which are each formed by the material flowing through the second feed channels 38' and 38, respectively. The latter are in turn between two material columns 40.4 and 40.5 that are adjacent the longitudinal furnace walls 18 and result from the material introduced via lateral feeders 42' and 42. The materials for the five columns can be distributed as follows:

Column 40.1—material 1: fuel, e.g. one or more of coal, coke, carbonaceous material, wood, charcoal, etc.

Column 40.2—material 2: material to be reduced, e.g. one or more of ore, waste, etc.

Column 40.3—material 3: material to be reduced, e.g. one or more of ore, waste, etc., possibly of different granulometry or different chemical composition than column 40.2 Often columns 40.2 and 40.3 may comprise the same materials.

Column 40.4—material 4: fuel, e.g. same materials as for column 40.1, reducing waste, etc. however possibly with different granulometry or different chemical composition Column 40.5—material 5: fuel, e.g. same materials as for column 40.1, reducing waste, etc. however possibly with different granulometry or different chemical composition than columns 40.1 and/or 40.4.

Again, for the production of pig iron columns 40.2 and 40.3 will mainly comprise iron ore and other iron bearing materials. Also, the pair of columns (40.2, 40.3), resp. (40.4, 40.5), can be fed with the same materials or with different materials, as indicated above.

Further to be noticed here is the general capacity of the furnace to operate with five different columns of materials, and the materials in each column need not necessarily be as described above. Those skilled in the art may decide to operate the furnace differently.

As will be understood, each column of material extends over the whole length of the vessel interior, as defined by vessel walls 18 and 18'.

Referring more specifically to the construction of the center shaft arrangement 32, it comprises a number of longitudinally extending walls that define the various feed channels and the off-gas passage, and that are supported by the frame structure 30.

Accordingly, the center hood 34 comprises two facing off-gas panels 44, 44' that define a central off-gas duct or channel 46 to evacuate gases rising from the furnace interior. Off-gas panels 44, 44' are sensibly vertically arranged, and preferably straight. The center hood 34 has a top cover 34.1 (in FIG. 2) closing the off-gas duct and provided a top opening for extraction piping (not shown).

Two partition walls 48, 48' are arranged on the sides of center hood 34 and cooperate with off-gas panels 44, 44' to define the first feed channels 36, 36'.

The partition walls 48, 48' cooperate also with further laterally arranged outer walls 50, 50' to define the second feed channels 38, 38'. The outer walls 50, 50' generally extend vertically; the upper portion is straight and parallel to the facing portion of the respective partition wall 48, 48'. In their lower region, outer walls 50, 50' are connected with the frame structure 30, defining a rectangular upper shaft passage 52 that is vertically aligned with the vessel opening 23.

The lateral feeders 42, 42' each include a pair of walls 42.1, 42.2 and 42.1', 42.2', which are here straight, inclined walls extending parallel to one another. Feeder wall 42.1, resp. 42.1', is connected to the frame 30 below the charge passage 52, i.e. downstream of the center shaft arrangement 14. The cooperating feeder wall 42.2, resp. 42.2', is also connected to the frame structure 30, but spaced from the other feeder wall to define the feed passage there-between that opens into the furnace and more precisely directly into the upper area of vessel 12, i.e. below the center shaft arrangement.

Conventionally, the vessel walls 18, 18' as well as the walls 44, 48, 50 . . . of the charging system 12 may be provided with internal cooling pipes/channels, typically arranged in the refractory lining, for circulating a coolant fluid.

It will be appreciated that the partition walls 48, 48' comprise lower wall portions 54, 54' that extend towards each other below the center hood 34 to define a center feed passage 56. By way of this design, material descending through the first feed channels 38, 38' may, before flowing through the center feed passage 56, accumulate on the lower portions 54, 54' according to the angle of repose of the granular material, thereby permitting self-adjustment of the first material stock-line, indicated 60, in the shaft arrangement 14.

As can be seen, the partition walls 48, 48' have straight upper portions 48.1, 48.1' and inclined lower portions 54, 54' converging towards the center of the furnace. The partition walls 48, 48' thus form a kind of funnel, in which the center hood 34 is arranged. As it will have been understood, the center hood 34 defines, with the upper region 48.1, 48.1' of the partition walls, the first feed channels 36, 36'. There the granular material is constrained between the cooperating walls. But once the granular material passes beyond/downstream the lower edges of the off-gas panels 48, 48', it is no longer vertically constrained by the latter. The granular material may thus freely accumulate on the beveled surfaces offered by lower partition walls 54, 54', where it will actually accumulate according to the angle of repose of the granular material.

The term 'angle of repose' is used herein according to its conventional meaning. That is, having regard to granular material, the angle of repose designates the maximum angle of a stable slope of a pile of such granular material. For example, when bulk granular material is poured onto a horizontal base surface, a conical pile forms. The internal angle between the surface of the pile and the base surface is known as the angle of repose; essentially, the angle of repose is the angle a pile forms with the horizontal.

Figure 2:
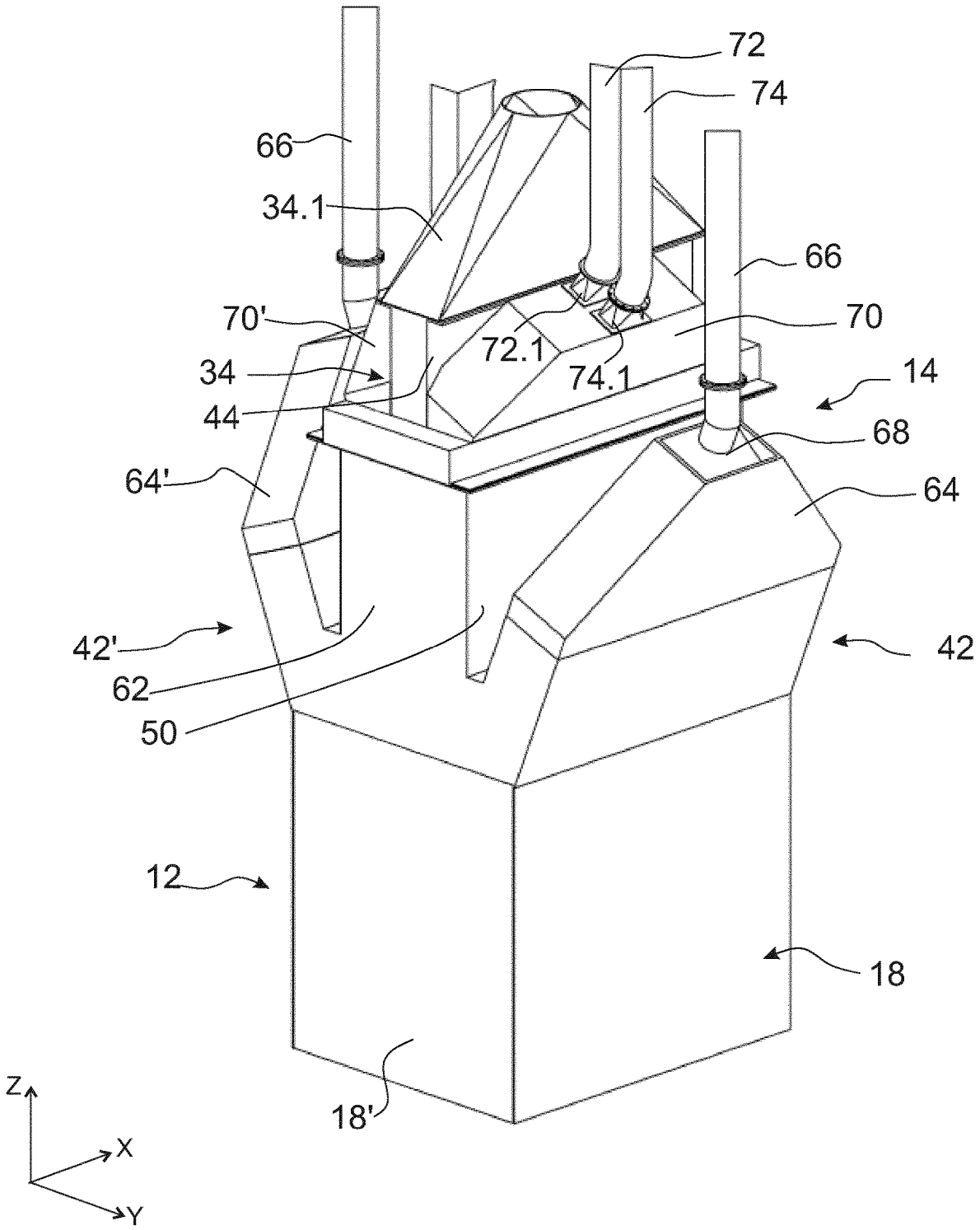
FIG. 2: is a perspective view of the shaft smelt reduction furnace of FIG. 1.

The shaft furnace 10 is shown in perspective in FIG. 2. One will recognize the rectangular shaped shaft smelt reduction vessel 12. The charging system 14 is designed as a gas-tight structure on top of vessel 12, connected to piping for evacuating off-gases and for supplying the respective feed channels. For this purpose, the whole center shaft arrangement 32, as well as the lateral feeders 42, 42', are advantageously enclosed in a metallic envelope. This envelope in internally covered with a refractory liner, thereby forming the outer walls 50, 50' as well as the walls of the lateral feeders 42, 42'. Also to be noted here, two opposite transversally (Y, Z plane) extending end walls 62 correspond (only one can be seen) to the end walls 18' of the furnace vessel and thus delimit the longitudinal extent of the center shaft arrangement 32, first and second feed channels and of the lateral feeders. This design makes it clear that all channels defined by said walls are open upwards and have a rectangular flow cross-section.

The top opening 42.3, 42.3' of each lateral feeder 42 is closed by a respective cover 64. Material, here coal, arrives therein from above via pipes 66 that are in communication with material supply means (not shown). Each pipe 66 opens into the respective cover 64, 64' at a charging point 68.

Similarly, a cover 70, 70' is arranged on each side of the center shaft arrangement 32 to cover the first and second channels 36, 36', 38 and 38'. An internal partition separates each cover 70, 70' into two regions so that pipes 72 communicate with the first channels 36, 36' and pipes 74 communicate with the second channels 38, 38'. Again, each of these pipes 72 and 74 are connected to respective charging points 72.1 and 74.1 in the cover and, at their upper ends, with material supply means. For example, each pipe or pair of pipes has its upper end in communication with a proportioning valve located downstream of a material hopper, generally via intermediate an intermediate bin and seal valves (not shown).

It may be noted here that, in the present charging system, the material is simply charged in the respective feed channels via the pipes into covers 64 and 70, without movable tubes or chutes. The material falls from the pipes into the respective covers and further in the corresponding feed channels; under its natural gravitary flow, the granular material tends to form a triangular heap.

Several charging points can be provided in each cover, if desired, in particular for furnaces of greater length.

The charging level in the respective feed channels can be monitored by means of radars, as is known in the art, or by any other appropriate system.

For the production of pig iron, iron bearing material is typically introduced as the second material, i.e. in the second feed channels (material 2 and 3 as described before). The iron bearing material is of granular form, typically with a particle size in ranging from 5 to 300 mm. If desired, the iron bearing material can be preliminarily formed into agglomerates, pellets, briquettes or the like, during hot or cold processing, using binders and/or additives. If desirable, the agglomerates may further contain reducing material, in particular to form self-reducing agglomerates.

Carbonaceous material is charge into the furnace via the first feed channels and the lateral feeders, e.g. using material such as materials 1, 4 and 5 described above The Carbonaceous material loaded into lateral feeders 42, 42' may have a size of 5 to 300 mm.

The charge level may be monitored in the respective channels by means of radars, as mentioned above.

It will however be appreciated that the stock-line level of the center material column adjusts itself based on the angle of repose of this material. This guarantees a constant stock-line level over the whole furnace length. The present charging system thus permits the building of a central column of material 1, which improves the efficiency of the thermal exchange between the ascending gasses and the charge by minimizing the wall effect. Furthermore, it ensures a constant and homogeneous charging level, which is beneficial in terms of permeability and distribution of the gasses.

In FIG. 1 a minimum and maximum charge levels for channels 36, 36' and 38, 38' are indicated Lmin and Lmax. This represents the base of the respective heap of material formed in the channels and further in the corresponding covers.

It may be noted that since the stock-line level 60 adjusts itself based on the angle of repose of the material residing on the lower portions 54, 54' of partition walls 48, 48', it is independent of the charge level in the channels 36 and 36'. However, the stock-line level 60 can be modified by changing the distance D between the lower edge of off-gas panels 44, 44' and the corresponding lower portions 36 and 36'. Therefore, off-gas panels 44 and 44' are preferably constructed as removable walls or as segmented walls, such that the lower portion can e.g. be replaced by another, longer or shorter wall portion. As it will be understood, increasing distance D will increase the stock-line level 60.

The invention claimed is:

1. A charging system for a shaft smelt reduction furnace, comprising:

a frame structure for mounting on a top charge opening of a shaft smelt reduction vessel;

a center shaft arrangement supported by said frame structure and configured to remove off-gas gases from the furnace and to introduce granular charge materials in order to form a stack of materials in the furnace, said center shaft arrangement comprising:

a center hood for off-gas extraction;

a pair of first feed channels for a first material, one on each side of said center hood; and a pair of second feed channels for a second material arranged on respective sides of said first feed channels;

wherein said center hood comprises a pair of facing off-gas panels defining an off-gas channel, each off-gas panel arranged in facing relationship with a respective partition wall to define a respective first feed channel; and wherein each partition wall cooperates with a respective outer wall to define a respective second feed channel;

wherein the partition walls comprise lower portions that extend towards each other below said center hood to define a center feed passage, whereby material descending through said first feed channels may, before flowing through said center feed passage, accumulate on said lower portions according to the angle of repose of said material, thereby permitting self-adjustment of the first material stock-line in the shaft arrangement.

2. The charging system according to claim 1, wherein each partition wall comprises a straight upper portion connected to said lower portions; and said lower portions of said partition walls extend lower than said off-gas panels and under said off-gas channel, said center feed passage having a narrower flow cross-section than said off-gas channel.

3. The charging system according to claim 1, further comprising two lateral feeders, each feeder mounted to said frame structure and opening into said furnace downstream of said center shaft arrangement.

4. The charging system according to claim 1, wherein said outer walls each comprise a lower portion connecting with said frame to define a charge passage, downstream of said center feed passage, that is vertically aligned with the vessel top charge opening.

5. The charging system according to claim 4, wherein the lower portion of each outer wall comprises an inwardly tapering section and a vertical section that is positioned in vertical alignment with the respective off-gas panel or further inward.

6. The charging system according to claim 1, wherein said off-gas panels are removably mounted in said center hood, in order to allow adjustment of the flow area between the lower edges of the off-gas panels and the corresponding lower portions of the partition walls.

7. The charging system according to claim 1, wherein a cover closes a top opening of each of said first and second feed channels, each of said cover comprising at least one charging point for connection to a material supply system.

8. A shaft smelting reduction furnace comprising: a shaft smelt reduction vessel and a charging system according to claim 1 mounted on a top charge opening of said smelt reduction vessel.

9. The shaft smelting reduction furnace according to claim 8, wherein said smelt reduction vessel has a rectangular cross-section.

10. The charging system according to claim 2, wherein said straight upper portion is vertical.

* * * * *